US005899683A

United States Patent [19]

Nolte et al.

[11] Patent Number: 5,899,683

[45] Date of Patent: May 4, 1999

[54] PROCESS AND DEVICE FOR OPERATING A GAS BURNER

[75] Inventors: Hubert Nolte; Martin Herrs; Roland Merker, all of Höxter; Norbert Schwedler; Eckart Bredemeier, both of Berlin, all of Germany

[73] Assignee: Stiebel Eltron GmbH & Co. KG, Holzminden, Germany

[21] Appl. No.: 08/850,789

[22] Filed: May 2, 1997

[30] Foreign Application Priority Data

| | | | |
|---|---|---|---|
| May 9, 1996 | [DE] | Germany | 196 18 573 |
| Jul. 11, 1996 | [DE] | Germany | 196 27 857 |
| Aug. 7, 1996 | [DE] | Germany | 196 31 821 |

[51] Int. Cl.[6] ..... F23N 1/02

[52] U.S. Cl. ..... 431/25; 431/12; 431/78

[58] Field of Search ..... 431/25, 12, 78, 431/79, 80, 20, 90, 63

[56] References Cited

U.S. PATENT DOCUMENTS

| | | | |
|---|---|---|---|
| 2,324,821 | 7/1943 | Campbell | 431/12 |
| 4,588,372 | 5/1986 | Torborg | 431/12 |
| 4,859,171 | 8/1989 | Altemark et al. | 431/12 |
| 5,049,063 | 9/1991 | Kishida et al. | 431/25 |
| 5,472,337 | 12/1995 | Guerra | 431/25 |

FOREIGN PATENT DOCUMENTS

| | | |
|---|---|---|
| 41 519 | 9/1965 | German Dem. Rep. . |
| 36 30 177 A1 | 3/1988 | Germany . |
| 37 12 392 C1 | 10/1988 | Germany . |
| 39 37 290 A1 | 6/1990 | Germany . |
| 43 09 454 A1 | 9/1994 | Germany . |
| 195 02 901 C1 | 3/1996 | Germany . |
| 44 33 425 A1 | 3/1996 | Germany . |

*Primary Examiner*—James C. Yeung
*Attorney, Agent, or Firm*—McGlew and Tuttle, P.C.

[57] ABSTRACT

In a process for operating a gas blower burner, a control circuit detects an ionization signal Ui derived from an ionization electrode, and it adjusts the gas-to-air ratio to a lambda set point >1, to which a set point Uis of the ionization signal corresponds. To guarantee low-emission combustion in different operating states, a range of control of the ionization signal Ui is set, whose upper limit value Uio is smaller than the maximum of the ionization signal Ui, and whose lower limit value Uiu is above the value that guarantees low-emission operation. A switch-off signal is generated for the burner if the ionization signal Ui leaves the permissible range of control RB for longer than a preset period of time. If the value is lower than the lower limit value Uiu of the ionization signal Ui and when the value is lower than the set point Uis at a lambda value <1, the control circuit increases the gas volume flow to an end value, and another switch-off signal is generated for the burner when this end value is reached.

19 Claims, 8 Drawing Sheets

PROCESS AND DEVICE FOR OPERATING A GAS BURNER

FIELD OF THE INVENTION

The present invention pertains to a process and a device for operating a gas burner, especially a gas blower burner wherein an ionization signal Ui derived from a ionization electrode arranged in the area of the flame is detected by a control circuit. The gas-to-air ratio (lambda I) is adjusted to a lambda set point >1 by changing the gas and/or air volume flows fed to the burner, with a set point (Uis) of the ionization signal corresponding to the said lambda set point.

BACKGROUND OF THE INVENTION

Such a process is described in DE 39 37 290 A1. The ionization electrode is in a d.c. circuit in this reference and the evaluation of the ionization current is problematic.

In Patent Application No. DE 44 33 425 A1, an alternating voltage, to which a d.c. voltage component that depends on the current of the ionization electrode is superimposed, is applied to the ionization electrode to improve the evaluability of the current flowing over the ionization electrode. An ionization voltage, which is a sufficiently accurate reflection of the current flame temperature and of the air ratio lambda (gas-to-air ratio), is derived from this.

It is also known that the heat output of a gas blower burner of a gas heater can be regulated by means of an automatic control unit corresponding to the heat demand, wherein the automatic control unit controls the speed of the blower as a function of an output set point, which depends on a room temperature set point and a heater flow temperature and/or the heater return temperature and an outside temperature.

Another control device for a gas burner has been known from DE 195 02 901 C1. It is based on the fact that the intensity of the flames is subject to continuous variations, i.e., there is a flickering flame pattern. It is recognized that the amplitudes of these variations depend on the gas-to-air ratio (lambda value) of the combustion gas. A safety flame monitoring to switch off the gas in the case of flame failure is not mentioned.

Gas-burning devices have been known to have to meet stringent safety requirements. According to safety regulations (EN 298), the flame failure controller in gas-burning devices intended for continuous operation performs a self-testing at regular intervals during operation, at least once an hour. In gas-burning devices intended for intermittent operation, the gas burner must switch off at least once within 24 hours in order to check the function of the flame failure controller. It is not ruled out that a defect may develop in the flame failure controller during the operation of the burner, and, in addition, the flame goes out. The automatic firing unit cannot recognize this at first and it cannot send a gas switch-off signal, as a consequence of which unburned gas is discharged until the next self-testing of the flame failure controller or until the burner is switched off.

An ionization flame failure controller, in which a capacitor charged to an operating voltage is discharged by the ionization current, has been known from DE 43 09 454 A1. The function of the ionization flame failure controller can be tested during the operation by means of a test signal. The ionization electrode itself and its connection cable and, in the case of certain disturbances, the capacitor cannot be tested. The flames are monitored only indirectly. In addition, the flame failure controller is tested by the test signal during periodically recurring time periods only.

SUMMARY AND OBJECTS OF THE INVENTION

The object of the present invention is to propose an improved process and a device of the type described in the introduction to guarantee a low-emission combustion in different operating states.

The above object is accomplished according to the present invention by providing an ionization electrode in an area of a flame of the gas burner. The ionization electrode generates an ionization signal Ui representing an ionization of the flame. The ionization electrode has a maximum Uim when lambda equals 1. The magnitude of the ionization signal drops off as lambda is less than and greater than one. The burner is operated at a lambda set point which is greater than 1, and an ionization set point of the ionization signal corresponds to said lambda set point. The lambda of the gas burner is adjusted to cause the ionization signal to be equal to the ionization set point a control range for said ionization signal is determined. The control range has an upper limit value Uio which is smaller than the maximum Uim of the ionization signal. The control range has a lower limit value Uiu which is above an end value Uie of the ionization signal. The end value Uie of the ionization signal corresponds to a lambda value "le" which is less than one and at which combustion of the flame is not low emission. The gas burner is switched off when the ionization signal is outside the control range for longer than a preset period of time. The gas burner is also switched off when the ionization signal equals the end value Uie.

The present invention does not directly determine if lambda is greater or less than one. The adjusting of lambda is such that if lambda is greater than one the adjusting uses negative feedback to have the ionization signal equal the set point. However if lambda is less than one, the adjusting will be using positive feedback. This positive feedback will increase the gas supply or throttle the air supply and quickly drive the ionization signal to the end value Uie of the ionization signal and cause the burner to switch off.

It is achieved as a result that the gas burner can be operated with low emission at least in the range of the Wobbe indices of natural gas (10 kWh/m$^3$ to 15.6 kWh/m$^3$). In addition, it is achieved that the control does not undesirably affect the desired thermal output to be generated by the gas heater operated with the gas burner, so that the gas heater can cover the heat demand with the required thermal output.

Another embodiment of the process pertains to the following problems:

The control circuit controls the gas-metering valve depending on the ionization signal such that the combustion takes place with a lambda set point of >1 desired for a low-emission operation, especially between 1.1 and 1.35. The control circuit itself is not used for the heat demand-dependent output adjustment. The adjustment of the heat output of the burner as a function of an output set point is performed in the known manner by means of the automatic control unit, which sets the speed of the blower in two or more steps or continuously. In the case of rapid changes in the output set point and correspondingly rapid changes in the speed of the blower, abrupt deviations may occur in the control circuit. These could lead to instabilities in the control circuit. To avoid the need for the control circuit to process great deviations, the derivative action component for the control signal of the gas-metering valve is derived from the speed change independently from the control circuit or in parallel to same. The control circuit will thus have to perform only a fine adjustment with relatively small deviation.

The derivative action component of the control signal is easy to obtain, because the device-specific output control signal characteristic is known from the manufacturer and thus it can be stored in the evaluating circuit.

Consequently, independently from the control circuit, the control signal for the gas-metering valve is immediately adjusted by the derivative action component changing the gas-metering valve in the case of a change in output or blower speed. The gas-metering valve is opened wider in the case of an increase in output; the gas-metering valve is closed more when the output is reduced. The control circuit itself now has to perform only a fine adjustment to the lambda set point. Consequently, it does not have to process great, abrupt deviations which are based on a change in output.

A tolerance range is preferably defined around the output control signal characteristic, and a switch-off signal is generated for the burner when the actual control signal leaves the tolerance range. The tolerance range is selected to be such that it will not be left during normal operation of the gas blower burner of the gas heater, or it is left only if the characteristics of the sensor mechanism, especially of the ionization electrode and/or of the transducer mechanism, or the actuator mechanism, especially of the gas-metering valve or of the air path of the ventilator or of the waste gas path or of the burner change in the course of the operation of the gas heater, e.g., due to dirt. The tolerance range is also left in the case of greatly varying Wobbe indices of the gas, greatly varying gas supply pressure or varying air resistance or in the case of malfunction of the control system. A switch-off signal is generated for the burner in all such cases, so that the burner will not continue to operate in a range unfavorable for low-emission combustion.

This switch-off signal may come into action immediately, or preferably when the tolerance range has been left for a certain period of time, e.g., 5 sec. Reliable and low-emission operation of the burner is thus guaranteed even after many operating hours. Switch-off signals may also be generated by the control circuit itself when the preset lambda set point cannot be maintained.

The automatic control unit switches on the gas blower burner again a certain time after the switch-off signal. If the switch-off signal occurs several times thereafter, a disturbance switch-off may be provided, after which the gas blower burner can be switched on only by service measures. Other, previously common safety devices may become unnecessary due to the setting of the tolerance range.

The tolerance range may be set symmetrically or asymmetrically or corresponding to a desired function relative to the output control signal characteristic.

It shall be achieved due to still another or additional embodiment that a gas switch-off signal appears when the flame is not present and also when there is a defect which generates a signal that is similar to the ionization signal, thus mimicking it, and such a defect may be present over the entire function section from the ionization electrode to a monitoring circuit.

A characteristic flame pattern, which influences the ionization signal, is used for monitoring in this embodiment. The variations in the flame intensity are utilized, evaluating the variations occurring because of the spontaneous flickering of the flame pattern which is due to the combustion in one design, and variations specifically modulated to the flame in the other design. The variations in amplitude are preferably evaluated. However, the phase or the frequency may also be evaluated, especially in the case of the specific modulation, instead of or in addition to it.

The gas switch-off signal, by which the gas supply is switched off, occurs not only when the flame goes out. It also occurs when a signal similar to and mimicking the true ionization signal is present as a consequence of any technical defect.

The gas switch-off signal occurs only if the characteristic variations in the flame pattern and consequently the ionization signal derived therefrom are not present. A technical defect of the devices, which mimics the characteristic variations of the flame pattern, is ruled out in practice.

The entire function section from the ionization electrode to the evaluating circuit is monitored by the process. Consequently, the gas switch-off signal appears regardless of whether the defect mimicking the ionization signal is present in the ionization electrode itself or in its connection line or in the monitoring circuit or elsewhere in the system. Very high safety of the system is achieved as a result, which even exceeds that of the current safety regulations.

The safety flame monitoring is performed continuously during the operation of the burner, i.e., with the flame burning, even with respect to the monitoring for technical defects. Consequently, it cannot happen that there is a rather long time after a defect during which unburned gas is discharged. In the case of the modulation specifically imposed to the flame, it may be sufficient for the modulation signal to be generated periodically, and the time between two consecutive modulation signals is selected to be so short that no dangerous amount of unburned gas can be discharged during this time.

The ionization signal does not have to be generated alone or separately for the safety flame monitoring. It may also be used at the same time for combustion control, which is described in DE 44 33 425 A1 or DE 195 02 901 C1.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
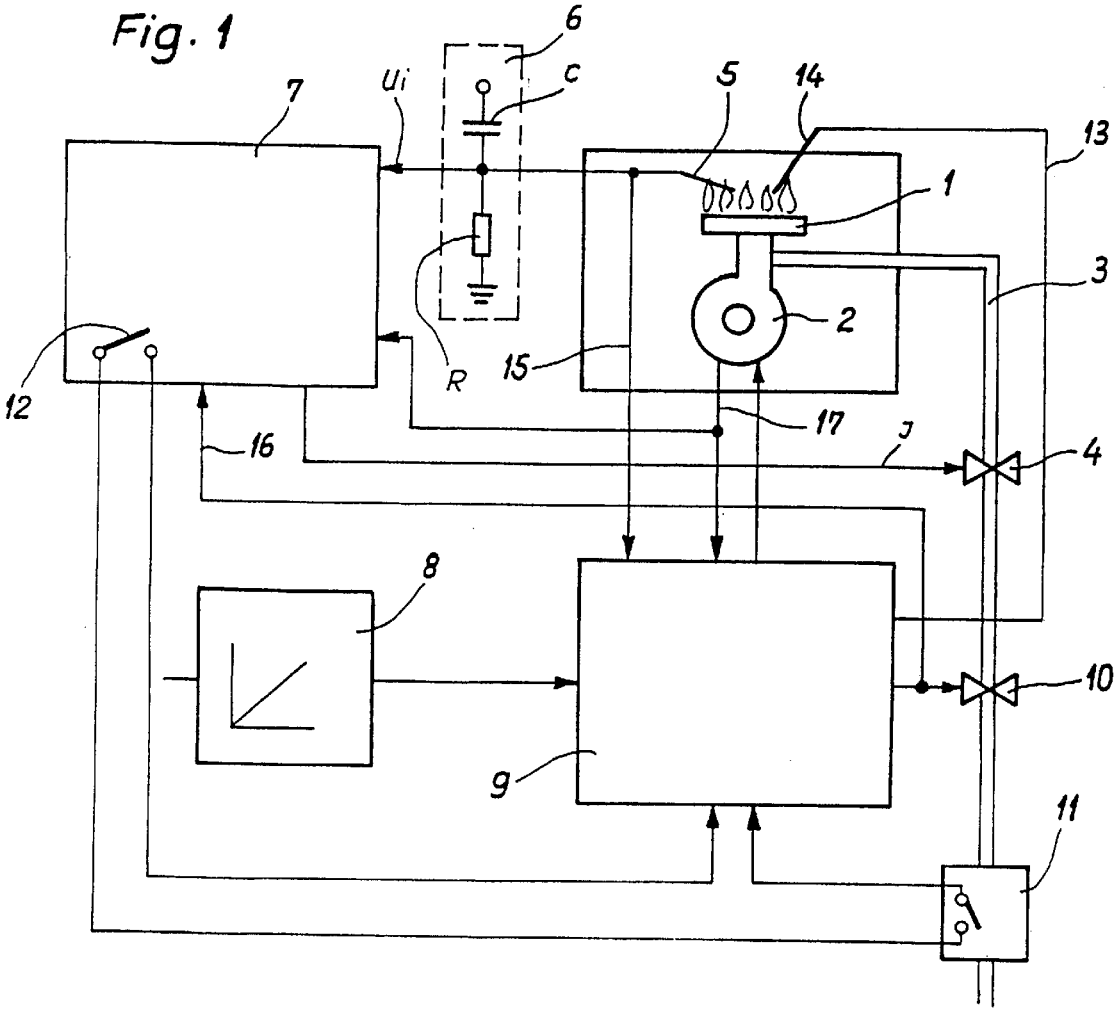
FIG. 1 schematically shows a control circuit of a gas blower burner for a gas heater.

Referring to the drawings, and in particular to FIG. 1, a blower 2 and a gas line 3, in which a gas solenoid valve 4 or another gas-regulating valve is located, are connected to a burner 1 of a gas heater. An ionization electrode 5, which is connected to an evaluating circuit 6 for the current flowing between the burner 1 and the ionization electrode 5 during the operation of the burner, is arranged in the area of the flame of the burner 1. The evaluating circuit 6 has, in particular, a capacitor C, to which the alternating line voltage is applied, and a resistor R. The evaluating circuit 6 forms an ionization voltage Ui from the ionization current, which depends on the combustion, and this ionization voltage is sent to a control circuit 7. The evaluating circuit 6 may also be integrated within the control circuit 7.

The control circuit 7 controls the degree of opening of the gas solenoid valve 4 by means of a control signal J, especially the control current. The control circuit 7 is supplied with the alternating line voltage. The control circuit also detects the power frequency and the power amplitude. The control circuit 7 is embodied, e.g., by a digital PI controller, e.g., a microprocessor.

An automatic control unit 9, as is known on the market under the tradename "Furimat," is provided for the two-step or multistep control of the blower speed. A safety valve 10 can be switched on and off by means of the automatic control unit 9, whereas the gas volume flow can be adjusted continuously by means of the gas solenoid valve 4. A set point setter 8, which sends a signal dependent on a room temperature set point and/or a heater flow temperature and/or a heater return temperature and an outside temperature to the automatic control unit 9, is connected to the automatic control unit 9.

A gas pressure switch 11, which switches off the burner operation in the case of insufficient gas pressure via the automatic control unit 9, is located in the gas line 3. A circuit breaker 12, which interrupts the operation of the burner via the automatic control unit 9 in the case of the controlled switch-offs and disturbance switch-offs described in greater detail below, is integrated in the control circuit 7 in series to the gas pressure switch 11.

The automatic control unit 9 sends an ignition pulse to an ignition electrode 14 of the burner 1 via a line 13 at the time of each switching-on. For flame monitoring, the ionization electrode 5 is connected to the automatic control unit 9 line 15. The line voltage is tapped from the safety valve 10 operated with line voltage, and it is applied to the control circuit 7 line 16. A speed control signal of the blower 2 is sent to the automatic control unit 9 and the control circuit 7 via a line 17.

The evaluating circuit 6, the control circuit 7 and the automatic control unit 9 may also be integrated within a single switchgear assembly.

The device according to FIG. 1 is advantageous, because the proven automatic control unit 9 with its control and safety functions can continue to be used for the burner 1 and the blower 2. The control circuit 7 needs to control the gas solenoid valve 4 only. The switch-off signals generated by it are evaluated by the automatic control unit 9. It is possible to retrofit already existing gas heaters equipped with the automatic control unit 9 with the control circuit 7.

Figure 2A:
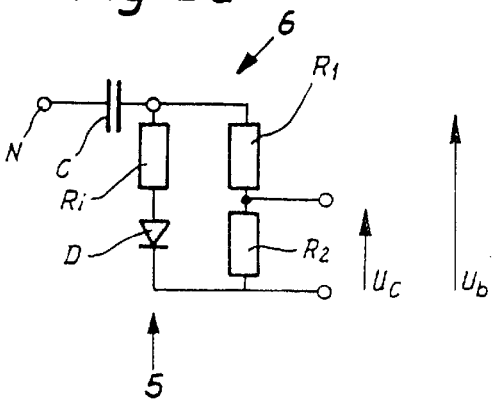
FIG. 2*a* shows a circuit for obtaining the ionization voltage with an equivalent circuit diagram of the ionization electrode.

FIG. 2*a* shows the evaluating circuit 6, wherein the ionization electrode 5 with its equivalent circuit diagram is shown as a resistor $R_i$ and diode D. A voltage divider consisting of resistors R1, R2 is connected in parallel to the ionization electrode 5 and Ri, D. The capacitor C is located between the power supply N and the voltage divider R1, R2 as well as the ionization electrode 5; Ri, D.

Figure 2B:
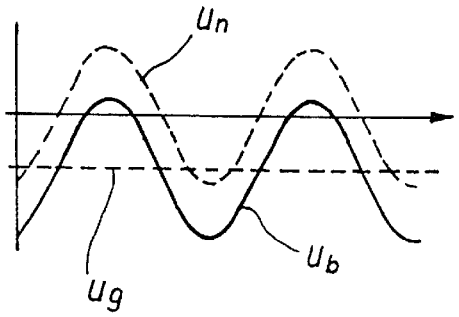
FIG. 2*b* shows corresponding voltage curves.

As a consequence of the rectifying action of the diode D, the alternating line voltage Un is shifted by a d.c. voltage component Ug to the voltage Ub see FIG. 2*b*, which is detected via the voltage divider R1, R2 as Uc. The d.c. voltage component Ug is then filtered out by means of a low-pass filter or by averaging, and it forms the ionization voltage Ui. The low-pass filter or the means for averaging are not shown in the figures. They may be provided in the evaluating circuit 6 or in the control circuit 7. Provisions may additionally be made to correct the ionization voltage Ui corresponding to a possible deviation of the alternating line voltage from the normal value 230 V. The use of the alternating line voltage in the evaluating circuit 6 is favorable, because the alternating line voltage is available anyway. However, it would also be possible to use another, sufficiently high alternating voltage.

Figure 3:
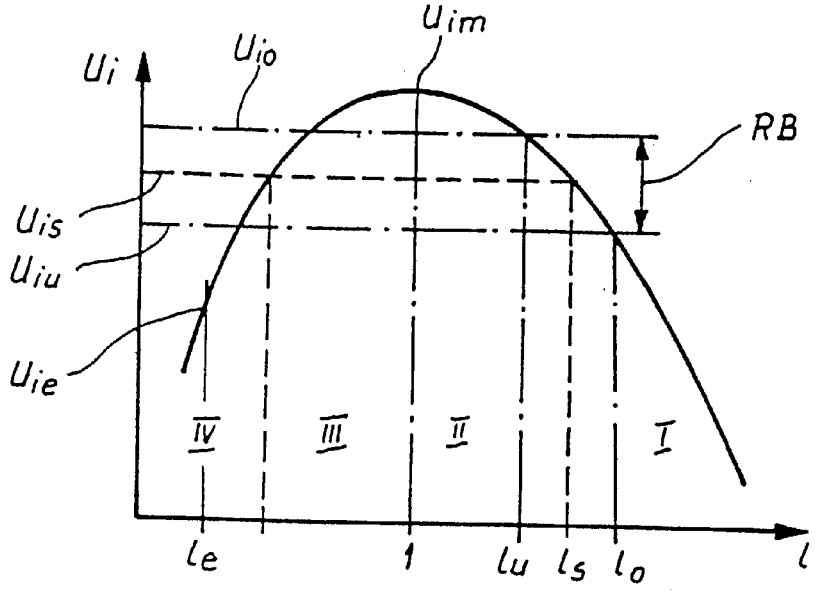
FIG. 3 shows the ionization voltage as a function of the air ratio lambda.

FIG. 3 shows the curve of the ionization voltage as a function of the air ratio lambda l of the state of combustion. A maximum Uim of the ionization voltage Ui occurs in the case of stoichiometric combustion l=1. The ionization voltage Ui decreases in the case of substoichiometric combustion l<1 and of superstoichiometlic combustion l>1. A lambda set point ls>1 between 1.1 and 1.35, e.g., 1.15, is desired for a low-emission combustion. An ionization voltage set point Uis corresponds to this see FIG. 3.

A permissible range of control RB with an upper limit value Uio and with a lower limit value Uiu is preset for the ionization voltage Ui in the control circuit 7. The upper limit value Uio is below the maximum value Uim. The lower limit value Uiu is above the end value Uie, which becomes established when the lambda value l is much lower than 1, i.e., the air-to-gas ratio is so rich because of maximal gas supply or minimal air supply that the combustion is no longer a low-emission combustion.

The ionization voltage Ui is detected anew at very short intervals of time, e.g., every 50 to 1,000 msec, and preferably about 100 msec. It is thus achieved that the ionization voltage Ui can never be outside the range of control RB for long, as a result of which a low-emission combustion is guaranteed when considered over the entire combustion process. During normal operation, the values of the ionization voltage Ui vary within the permissible range of control, i.e., between Uio and Uiu, so that the lambda value l is correspondingly controlled to the lambda set point ls in the range lo to lu.

If the ionization voltage drops below the ionization voltage set point Uis, the control circuit 7 opens the gas solenoid valve 4 wider via the control signal J, as a result of which the combustion is controlled in the direction of the lambda set point ls. If the ionization voltage exceeds the ionization voltage set point Uis, the control circuit 7 energizes the gas solenoid valve 4 such that the gas supply will be reduced, as a result of which the lambda value is again controlled to the lambda set point ls. This applies to both the range of control RB and combustion states outside the range of control RB.

If the ionization voltage Ui drops below the lower limit value Uiu of the ionization voltage Ui as a consequence of a lambda value that is greater than lo, a timer, which may also be embodied in the control circuit itself, is activated by the control circuit 7. The gas solenoid valve 4 is opened wider in this range I in FIG. 3 in order to reach the lambda set point ls again. If the ionization voltage Ui returns into the range of control RB within the period of time preset by the timer, e.g., 3 sec to 10 sec, nothing else will happen. The burner 1 continues to operate and the timer is reset. However, if the ionization voltage Ui fails to reach the range of control again during this period of time, a switch-off signal is generated for the burner 1 due to the opening of the circuit breaker 12. Controlled switch-off of the burner 1 takes place. The burner 1 is restarted a short time after the controlled switch-off, e.g., 5 to 50 sec. If such a controlled switch-off then takes place several times, e.g., three times, the burner 1 will no longer be restarted automatically, but a disturbance switch-off will be performed by keeping open the circuit breaker 12, and this disturbance switch-off is displayed, and it can be eliminated only by a special intervention from the outside.

If the air ratio lambda l decreases to such an extent that the ionization voltage Ui now exceeds the upper limit value Uio of the range of control RB, the timer is again activated, and the control signal J modulation current for the gas solenoid valve 4 is changed such that the gas volume flow or the gas pressure is reduced in order to reach the lambda set point ls again. This happens in the range II and III of FIG. 3. The deviation control is performed more rapidly in the case of Ui>Uis than in the case of Ui<Uis because of the control characteristic see FIG. 6 described in greater detail below. The sensitivity is highest and the speed of deviation control is consequently the highest at Uim. The air ratio can consequently be very short only, <lu or <l.

However, if the period of time preset by the timer is exceeded, a switch-off signal is again generated for the burner. The burner is restarted after a time delay, and a disturbance switch-off takes place in the above-described manner when the switch-off signal appears again.

If the air ratio l drops so much <1 due to any conditions that the ionization voltage Ui drops below the set point Uis in range IV, this leads to a change in the control signal J, just as in range I, and this change causes the gas solenoid valve 4 to open wider, so that the air ratio becomes even lower. The controlled switch-off now works in positive feedback see range IV in FIG. 3. The end value le of the air ratio l or the end value Uie of the ionization voltage or the maximum of the control signal J is reached very rapidly due to the long scanning period 100 msec and the positive feedback of the detection of the ionization voltage, which is due to control engineering reasons, and the gas solenoid valve 4 is fully open. If the maximum of the control signal is reached, this is detected by the control circuit 7, which activates a switch-off signal for the burner. This switch-off signal must not switch off the burner immediately. It is also sufficient for the burner to be switched off only with a time delay preset by another timer, e.g., 5 sec. This is favorable for the following reason: It is not ruled out that the gas solenoid valve 4 is at first jammed when the modulation current J, which is the control signal, increases, so that the gas solenoid valve does not yet open wider, even though the modulation current assumes its maximum. The gas solenoid valve 4 has time during the time delay to start moving, and if it does so, a needless switch-off of the burner is avoided.

The occurrence of the minimum of the control signal J is also correspondingly detected electronically and is evaluated for a controlled switch-off. Switching off of the burner 1 is guaranteed as a result when the minimum of the control signal J has been reached, but the gas solenoid valve 4 fails to close for whatever reason.

Figure 4:
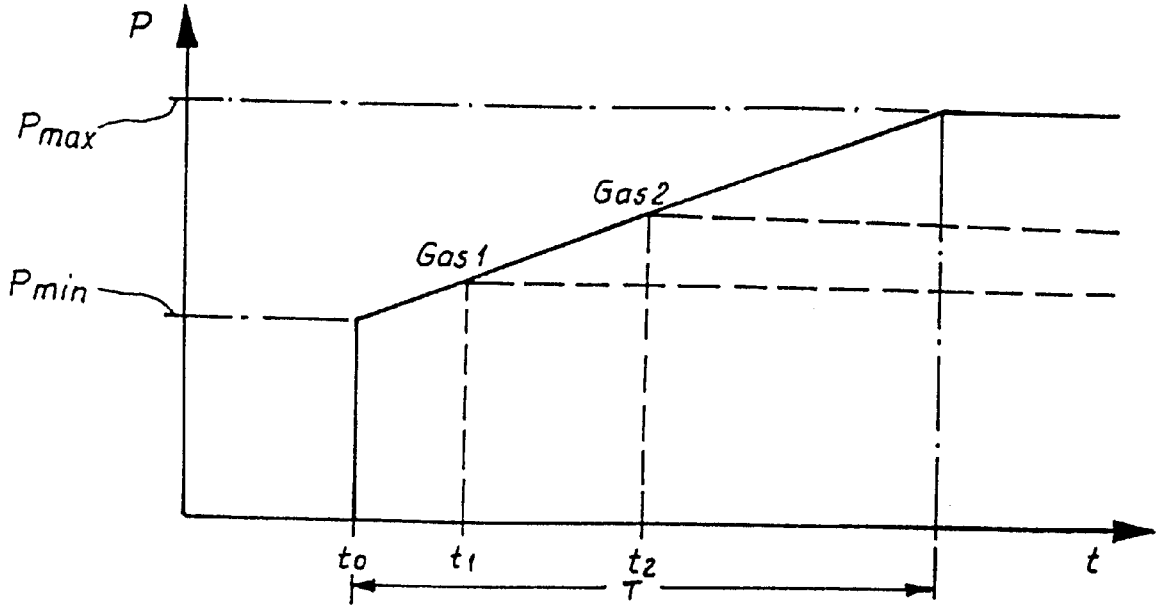
FIG. 4 shows a gas-versus-time diagram at the start of the burner.

A start gas ramp, see FIG. 4, according to which the gas pressure or the gas volume flow is increased continuously from pmin to pmax during a safety time T due to the energization of the gas-metering valve 4 at each start of the burner 1, is preset in the control circuit 7. pmin and pmax are selected to be such that the burner will start reliably at each Wobbe index of the class of gas in question, e.g., natural gas.

At each start of the burner, the blower 2 is first accelerated to a constant speed. The gas solenoid valve 4 is increasingly opened after a preliminary purging time for the combustion chamber at time t0. The optimal gas-air mixture is reached at time t1, gas 1, in the case of a higher-calorie gas, so that the ignition takes place. The corresponding position of the gas solenoid valve is now maintained until the end of the safety time T. The above-described control begins only thereafter. The ignitable mixture is obtained, e.g., only at time t2 in the case of a low-calorie gas. The ignition will then take place, and this position of the gas solenoid valve will be maintained until the end of the safety time T. Consequently, the ignition is guaranteed at each Wobbe index of the particular gas.

The control circuit 7 operates as a preferably digital PI controller, which detects the ionization voltage with a scanning period of, e.g., 100 msec, which was mentioned above, and calculates the new value for the control signal J at the same frequency. The particular change dJ in the control signal is composed of the changes caused by the I control part and the P control part changed compared with the last set value.

Figure 5A:
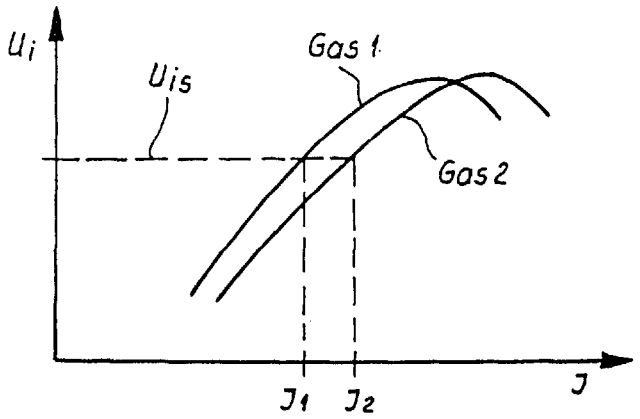
FIG. 5*a* shows a control diagram for a higher-calorie gas and for a low-calorie gas.

At a given desired output of the burner, a lower control signal J1 is necessary in the case of a higher-calorie gas at equal ionization voltage set point Uis, gas 1 in FIG. 5*a*, than in the case of a low-calorie gas, gas 2 in FIG. 5*a*. The higher control signal J2 is needed for Uis in the case of the low-calorie gas, see FIG. 5*a*. This is taken into account by the control circuit.

Figure 5B:
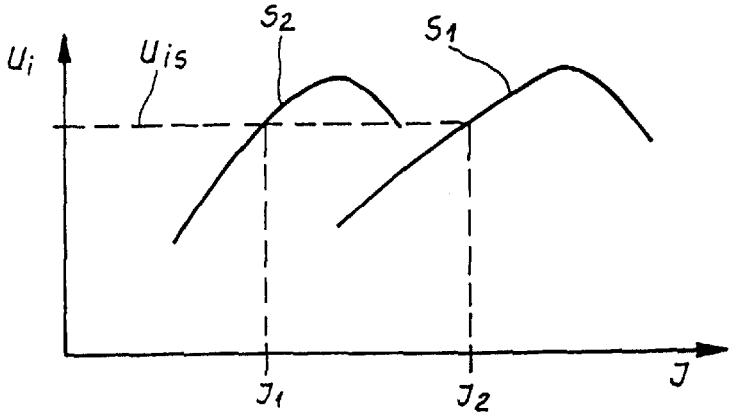
FIG. 5*b* shows a control diagram for a lower thermal output and for a higher thermal output.

The conditions are also similar when the burner 1 is to be operated at a power stage S1 of higher output and at a power stage S2 of lower output by correspondingly setting the blower speed see FIG. 5*b*. The control circuit 7 detects the blower speed or determines the load from the position of the connected gas solenoid valve 4 via the line 17 and sets higher values of the control signal J at equal ionization voltage set point Uis at the higher power stage S1 than at the lower power stage S2 see FIG. 5*b*.

Figure 6:
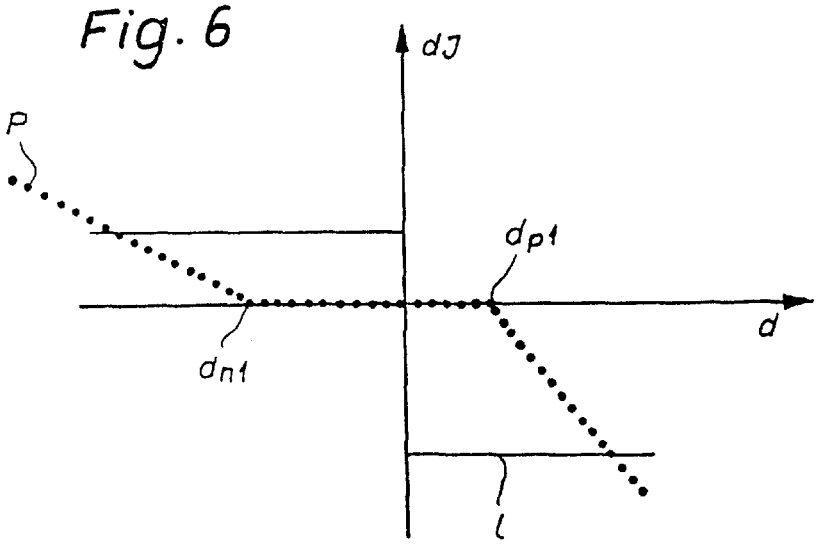
FIG. 6 shows a control characteristic.

FIG. 6 shows the change dJ in the control signal as a function of the deviation d of the corresponding ionization voltage Ui from the ionization voltage set point Uis. It is seen that at equal positive and negative deviations d, the change dJ in the control signal is greater in the case of positive deviations above dp1 than in the case of equal negative deviations below dn1. FIG. 6 also shows that the P control component becomes active only beginning from a certain positive or negative deviation dp1, dn1. There is no change dJ in the control signal between the deviations dp1, dn1. It is guaranteed as a result that the control signal J is not changed continuously in the case of inevitable dispersions in the measured values of the ionization voltage Ui, and the gas solenoid valve 4 also is not adjusted during every deviation, however small or short it may be, which deviation does not practically affect the low-emission operation of the burner.

The P control component is indicated by dotted line in FIG. 6. The I control component is indicated by a solid line. The I control component leads to a longer adjustment time in the case of negative deviations than in the case of positive deviations.

An alternating current, e.g., one with the power frequency of the control circuit 7, is superimposed to the modulation current J. The amplitude of the superimposed a.c. current component is substantially smaller than the control signal J as such, which is, e.g., between 30 mA and 150 mA. The valve hysteresis caused by the mechanical design of the gas solenoid valve 4 is reduced by the superimposed a.c. current component, so that the gas solenoid valve 4 responds quickly to changes dJ in the control signal in both directions.

Figure 7:
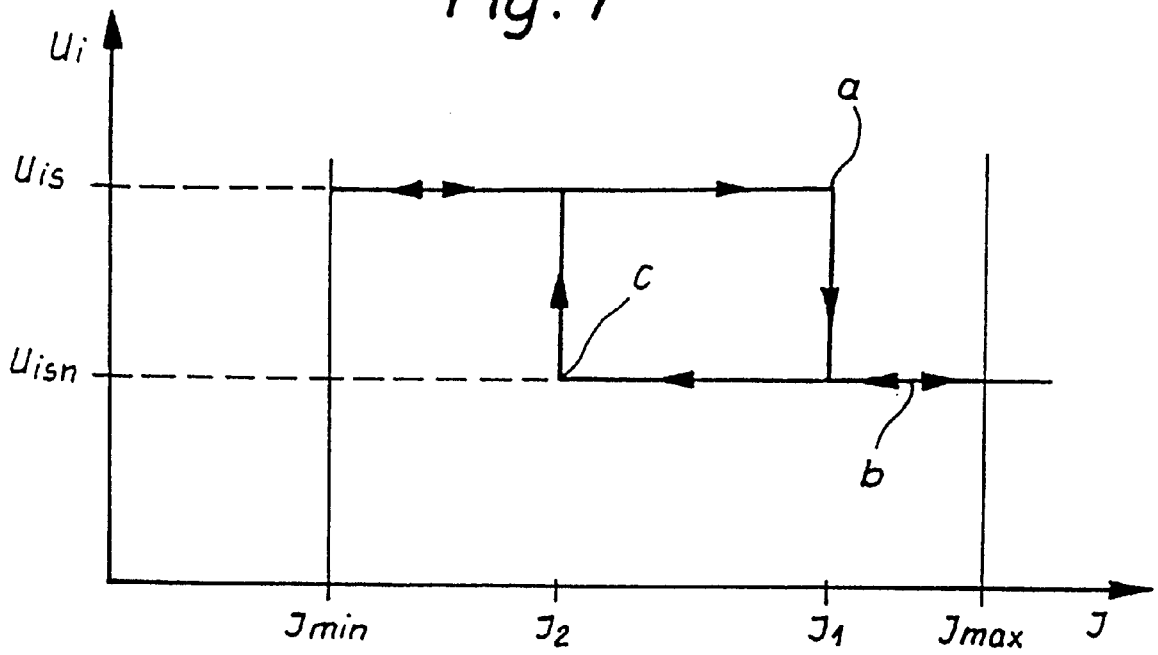
FIG. 7 shows a diagram of an air ratio control in the case of a very low-calorie gas.

If the burner is supplied with a very low-calorie gas and the blower speed cannot be reduced to maintain the full-load operation, it may happen that the combustion will be switched off even if the gas solenoid valve 4 is maximally open or if the maximal control signal J is present. To avoid this, i.e., to maintain the heating operation, a higher value of the air ratio is permitted for a limited time. The control circuit will correspondingly reduce the ionization voltage set point Uis for a limited time. The conditions are shown in FIG. 7. Threshold values J1, J2 are preset for the control signal J in the control circuit 7. If low-calorie gas, which may lead to a controlled switch-off of the combustion, appears at the ionization voltage set point Uis, the control circuit 7 will first increase the control signal J in the manner described in order to correspondingly increase the gas supply. However, if the upper threshold value J1 is reached, the control circuit 7 reduces the ionization voltage set point to a low-caloric value Uisn, point "a" in FIG. 7. Even though this is associated with a slight increase in the lambda value, it is guaranteed that the burner 1 will continue to operate. The control signal J will then decrease in the direction of the lower threshold value J2 again if the calorie of the gas decreases further, arrow b in FIG. 7. This would lead to a controlled switch-off or to a disturbance switch-off. If the lower threshold value J2 is then reached, the control circuit 7, see c in FIG. 7, will switch back again to the original ionization voltage set point Uis.

The relationships between the ionization electrode 5 and the gas flow set by the solenoid valve 4 may be shifted during the operation, e.g., due to combustion residues on the ionization electrode 5 and/or to the bending and/or wear of the electrode or deposits in the gas-metering valve 4. A calibration function is therefore integrated within the control circuit 7. The calibration function is activated at regular intervals by an event counter, e.g., a counter of the switch-on or switch-off processes or by a running time meter. The control function described is switched off during the calibration. The calibration is preferably performed at constant speed of the blower 2 in order to suppress the effect of the blower 2 on the combustion. It is favorable to carry out the calibration at an average speed in order not to reach the modulation limits of the control signal J during the calibration. The calibration may also be performed during the switching over of the blower 2 from one power stage to the other power stage, because the change in speed is slow compared with the calibration process, so that the speed is quasi constant during the calibration process.

Figure 8:
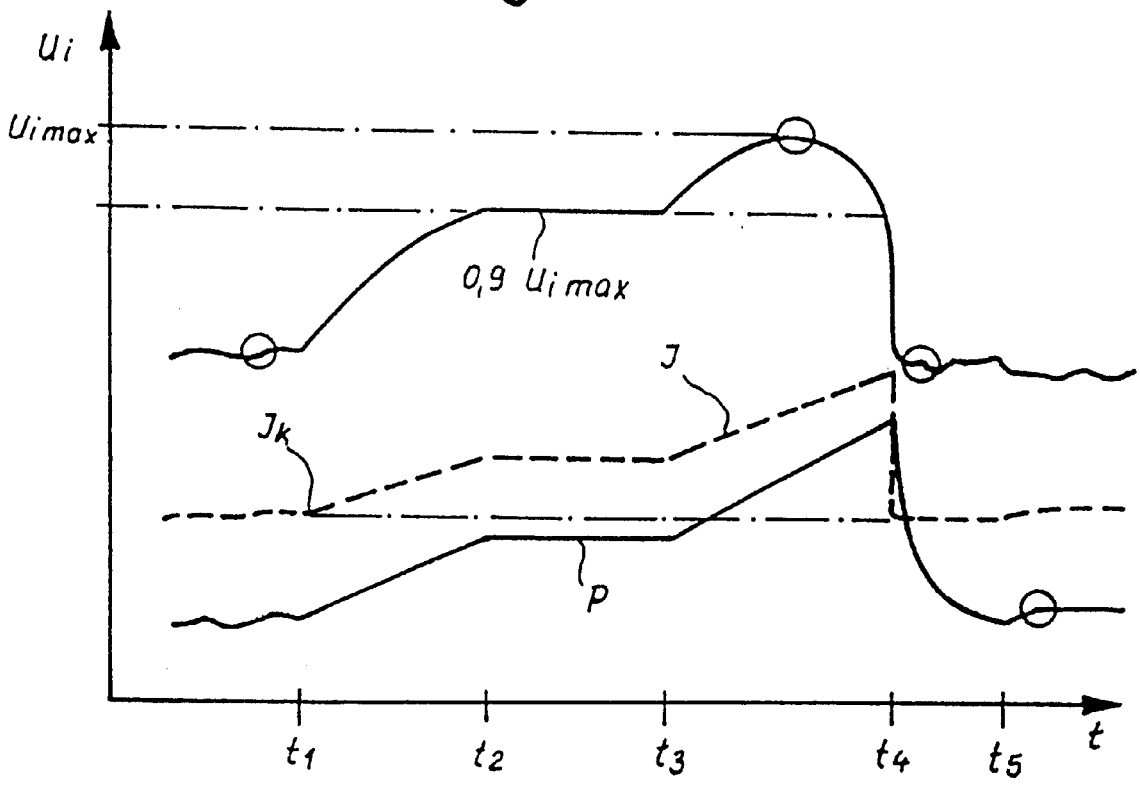
FIG. 8 shows time diagrams at the start of a calibration process.

The calibration process is started by the event counter or running time meter at time t1, see FIG. 8, at the time of the transition from the full-load stage to the partial load stage of the blower 2, when the decreasing modulation current J reaches a low value Jk. This value is stored by the control circuit. The modulation current J is then increased by the control circuit 7, and the gas supply is thus increased as well via the gas solenoid valve 4, as a result of which the ionization voltage Ui increases correspondingly. The ionization voltage Ui reaches a predetermined value, e.g., 0.9 Uimax, at the time t2. The period of time t1 to t2 is used to start up the preheating of the ionization electrode 5. The modulation current J is maintained at a constant value beginning from time t2 until time t3. The ionization electrode 5 is heated during this period of time t2 to t3 to a stable temperature, and it guarantees reproducible measured values as a result.

The modulation current J is increased further by the control circuit 7 after the time t3 such that the maximum Uimax of the ionization voltage Ui is surpassed. This—new—maximum Uimax and/or the measured values obtained during the period of time t3 to t4 is/are stored for further processing during the calibration process.

The modulation current J is increased further until the ionization voltage Ui again reaches a value about 10% below the Uimax value, which happens at the time t4 in FIG. 8. The lambda value of the combustion is unfavorable per se during the period of time t3 to t4, but this is not relevant, because the duration of this period of time is at most a few sec.

Using the modulation current JK stored previously, the control circuit 7 switches back to the above-described control process after the time t4. This control process begins when the ionization voltage Ui, the modulation current J, and the gas pressure p have stabilized at the time t5.

The control circuit 7 derives a correspondingly adjusted new set point for the ionization voltage Uis from the stored—new—maximum of the ionization voltage and from the measured values obtained during the period of time t3 to t4.

Based on the said short scanning period of the control circuit 7, a series a measured values will also be obtained during the period of time t3 to t4. Measured values that differ greatly from the other measured values of the series are suppressed, because they may be due to external electrical interfering pulses.

To avoid the effect of calibration measured value series which occur only temporarily and are still tolerable, though unusual, an averaging between the new measured value series and the measured value series of preceding calibration processes may be performed.

Before a recalibration of the set point of the ionization voltage Uis is indeed performed with the new calibration value, which may be derived from the new maximum of the ionization voltage or from the measured value series, two transfer criteria are tested by the control circuit 7.

The first transfer criterion detects a sudden change in all components of the control circuit. It is met if the deviation of the new calibration value from the previous calibration values is sufficiently small.

The second transfer criterion detects a "creeping drift" of the system burner control, which is sufficiently small in the case of deviation from the values provided by the manufacturer.

The burner operation with the recalibration is continued only if both transfer criteria are met. If one of the transfer criteria is not met, the burner operation is first interrupted by a controlled switch-off, and, after several repetitions, by a disturbance switch-off.

The switch-off processes of the burner 1 can be summarized as follows:

The automatic control unit 9 switches the safety valve 10 and the blower 2 as a function of the heat demand and the gas pressure in the usual manner "normal controlled switch-off".

The control circuit 7 performs a controlled switch-off by opening the circuit breaker 12 for a limited time if a) the range of control RB is left during the control process for longer than a predetermined time, e.g., 5 sec, in the case of positive or negative deviations, or b) the maximum or the minimum of the control signal J is reached during the control process for a time longer than a predetermined time, e.g., 5 sec, or c) the ionization voltage Ui changes greatly during the calibration process during the preheating time t2 to t3 of the ionization electrode 5, or d) the maximum of the control signal J is reached during the calibration process, or e) the first or second transfer criterion is not met during the calibration process.

After a controlled switch-off, the automatic control unit 9 switches the burner 1 on again.

The control circuit 7 leads to a disturbance switch-off, which can be eliminated only by special measures, e.g., by permanently opening the circuit breaker 12, if f) a controlled switch-off according to "a" took place repeatedly, e.g., three times, or g) a controlled switch-off according to "b" took place repeatedly, e.g., three times, or h) a controlled switch-off according to "c, d, e" took place repeatedly, e.g., three times.

The repeated controlled switch-offs are detected by counters. The counters for the controlled switch-off "a, b", or disturbance switch-offs "f, g" are reset by each "normal controlled switch-off" of the automatic control unit 9. The counter for the controlled switch-offs "c, d, e" or the disturbance switch-off "h" is reset at the time of a valid calibration.

The disturbance switch-off may also be initiated by the control circuit 7 closing the gas solenoid valve 4 by means of the minimum of the control signal J. The contact of the gas pressure switch 11 remains at first open. The automatic control unit 9 will then detect the extinction of the burner flame via the line 15, after which it closes the safety valve 10. The automatic control unit 9 will then attempt to reignite the burner 1, while line voltage is applied to the safety valve 10, and the line voltage is also transmitted to the control circuit 7 via the line 16 as a result. However, the attempt at ignition may be unsuccessful, because the gas solenoid valve 4 is closed. The automatic control unit 9 switches over to "Disturbance" after several, e.g., four, unsuccessful attempts at ignition, and it reports "no ignition possible." The control circuit 7 counts the attempts at ignition of the automatic control unit 9 and then opens the circuit breaker 12 after a certain time, e.g., 10 sec after the end of the fourth attempt, so that the automatic control unit 9 will now also close the safety valve 10 for safety. A high level of safety of operation is thus achieved, and the safety features present in the automatic control unit 9 are utilized.

Figure 9:
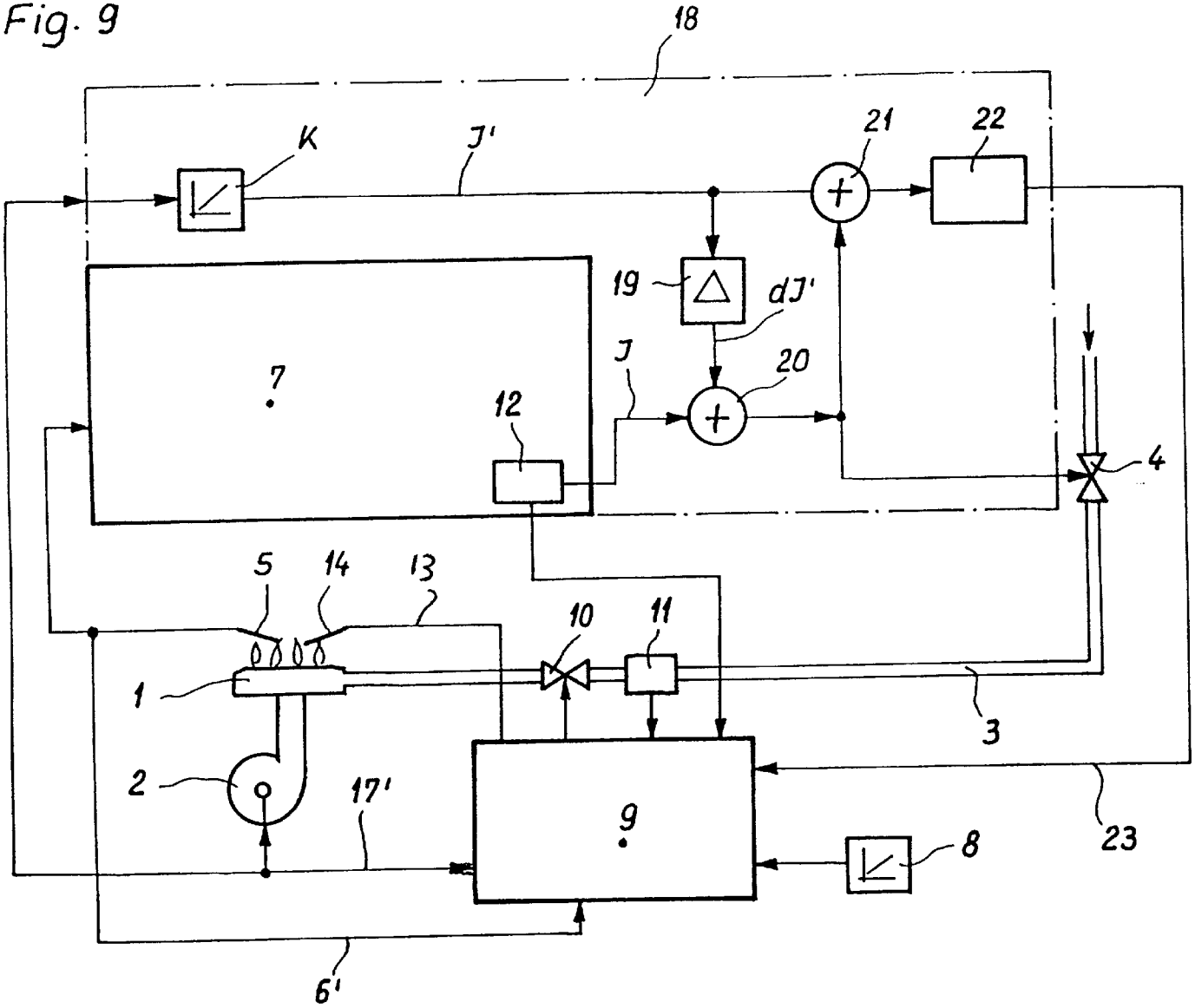
FIG. 9 shows a block diagram of a control of a gas blower burner.
Figure 10:
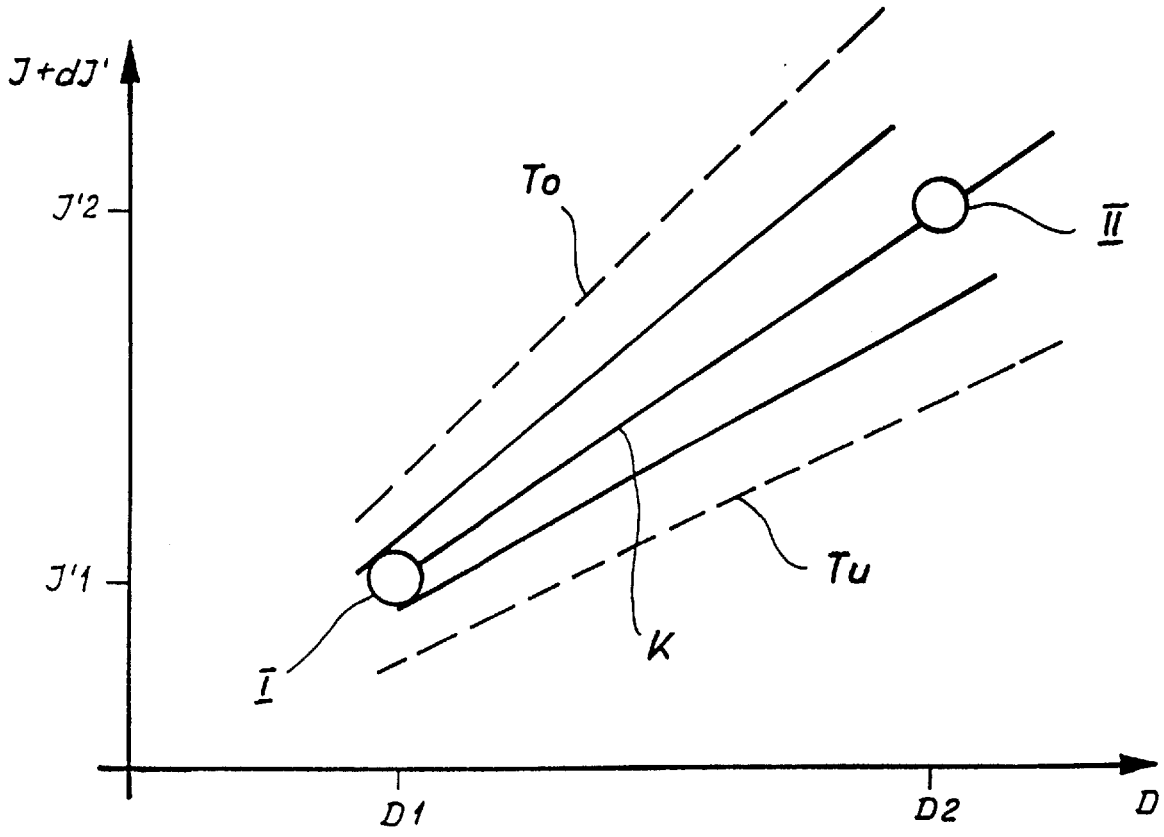
FIG. 10 shows an output control signal characteristic with tolerance range.

Explanations to the exemplary embodiment according to FIGS. 9 and 10:

A blower 2 and a gas line 3, in which a gas solenoid valve 4 acting as a gas-metering valve is located, are connected to a burner 1 of a gas heater. An ionization electrode 5, which is connected to a control circuit 7, is arranged in the area of the flame of the burner 1. Via the line 6', the signal of the ionization electrode 5 is also sent to the automatic firing unit 9 described in greater detail below. Thus, there is a possibility in the automatic firing unit 9 to monitor the burner 1 for the presence or absence of a flame. The control circuit 7 controls the degree of opening of the gas solenoid valve 4 as a function of a current flowing over the ionization electrode 5 and of a preset lambda set point by means of a control signal J, especially the control current. The control circuit 7 is, e.g., a digital PI controller, which is embodied by, e.g., a microprocessor. A low-emission combustion, e.g., one at a lambda set point between 1.1 and 1.35, preferably at 1.15, is guaranteed by the control circuit 7.

An automatic control unit 9, as is known on the market, e.g., under the tradename "Furimat," is also used for the two- or three-step or continuous control of the blower speed in this embodiment. A safety valve 10 can be switched on and off by means of the automatic control unit 9, whereas the gas volume flow can be adjusted continuously by means of the gas solenoid valve 4. A set value setter 8, which sends a signal dependent on a room temperature set point and/or a heater flow temperature and/or a heater return temperature and an outside temperature to the automatic control unit 9, is connected to the automatic control unit 9.

A gas pressure switch 11, which switches off the burner operation via the automatic control unit 9 in the case of insufficient gas pressure, is located in the gas line 3. A circuit breaker 12, which interrupts the operation of the burner via the automatic control unit 9 when the desired lambda set point is not guaranteed, is integrated within the control circuit 7.

The automatic control unit 9 sends an ignition pulse to an ignition electrode 14 of the burner 1 via a line 13 at the time of each switching-on. A signal determining the speed of the blower 2 is sent by the automatic control unit 9 to the blower 2 via a line 17', on the one hand, and to an evaluating circuit 18, on the other hand.

The device-specific speed characteristic, i.e., the output control signal characteristic K, is stored in the evaluating circuit 18. This characteristic represents, regardless of the particular setting of the control circuit 7, the relationship between the degree of opening of the gas solenoid valve 4 necessary for reaching the desired burner output at a given blower speed. The evaluating circuit 18 generates a reference signal J' corresponding to the characteristic K. In one part 19 of the circuit, the evaluating circuit detects the change in the reference signal J' compared with the previous state. This change dJ', which corresponds to the change in the speed, is imposed by it as a derivative component to the control signal J positively or negatively via an adder 20. As a result, the control signal J is preadjusted to the desired output or to the blower speed corresponding to the change in the speed in parallel to the control circuit 7. The gas solenoid valve 4 is opened wider or closed more by an amount approximately corresponding to the desired change in output. The control circuit 7 consequently does not have to process the desired change in output itself. It controls the gas solenoid valve 4 to the lambda set point necessary for a low-emission combustion at the given output setting.

The reference signal J' and the control signal J changed by the derivative component dJ' are sent to a comparator 21. The latter is connected to a correlator 22, in which a tolerance range with an upper tolerance limit "To" and a lower tolerance limit Tu is stored, cf. FIG. 2. The correlator 22 detects whether the current value is still within the tolerance range "To, Tu" or whether it has moved outside the tolerance range. If the current value of the control signal J changed by the derivative component dJ' has moved out of the tolerance range located around the characteristic K, this is a sign that a low-emission combustion is no longer guaranteed to the desired extent for whatever reason. This may be due, e.g., to deposits or wear in the area of the burner 1, of the ionization electrode 5, of the blower 2, of the gas solenoid valve 4 or of the air supply, or to malfunctions occurring in the electronic system, or to the gas conditions. For whatever reason, the correlator 22 sends a switch-off signal in the case of such disturbances to the automatic control unit 9 via the line 23. This does not need to happen immediately at the beginning of the disturbance. Switching off is preferably performed only when the disturbance has lasted for a certain time, e.g., 5 sec.

Provisions may be made for the automatic control unit 9 to restart the burner 1 a certain time after the switch-off. If the switch-off signal from the correlator 22 then appears several times, e.g., three times, the automatic control unit 9 is switched to disturbance, so that the burner 1 can be switched on again by the service personnel only.

The functions of the evaluating circuit 18 with the storage of the characteristic K, with the circuit part 19, with the adder 20, with the comparator 21 and with the correlator 22 may be embodied in a microprocessor, which also assumes the functions of the control circuit 7.

The characteristic K is shown in FIG. 10; the blower 2 is running at a speed D1 for a low power stage at point I. In the ideal case—without the need for adjustment by the control circuit 7—this corresponds to a control signal reference signal J'1. A reference signal J'2 is correspondingly obtained from the characteristic K, see point II, at a higher speed D2 for a higher output stage. The characteristic K is essentially linear between the points I and II. However, this is not necessarily so; it may also be described by a declining curve. The tolerance range with its upper tolerance limit To and its lower tolerance limit Tu is located above and below the characteristic K. The range of control to be managed by the control circuit 7 is located within the tolerance limits. The tolerance range does not have to be symmetrical to the characteristic K. Depending on the specific properties of the device, it may also be asymmetric or even spread or even be defined according to special functions.

As long as the control signal J+dJ' acting on the gas solenoid valve 4 is within the tolerance range, the correlator 22 does not introduce any switch-off signal. However, if this value leaves the tolerance range at the speed D1 or at the speed D2 or at a speed in between, the switch-off signal is introduced.

Explanations to the exemplary embodiment according to FIGS. 11 through 14:

A gas line 3, in which a gas valve 4 which can be switched off and controlled, e.g., a solenoid valve, is located, is connected to a gas burner 1 for a gas heater. An air supply connection 2' and optionally an air-delivering, speed-controllable blower 2 are arranged at the gas burner 1. The blower 2 is not always necessary; the burner may also be an atmospheric gas burner.

An ionization electrode 5 extends into the area of the flame of the gas burner 1. An alternating voltage, preferably the line alternating voltage U, is applied to the ionization electrode 5 via a capacitive coupling member 27. The coupling member 27 comprises a capacitor and a resistor. The coupling member 27 is electrically grounded via a resistor 28, as is the gas burner 1.

A voltage divider 29, which reduces the voltage occurring by a factor of, e.g., 10, is connected to the ionization electrode 5. A filter 210, which filters out the frequency of the coupled alternating voltage 50 Hz, is connected to the voltage divider 29.

Figure 12:
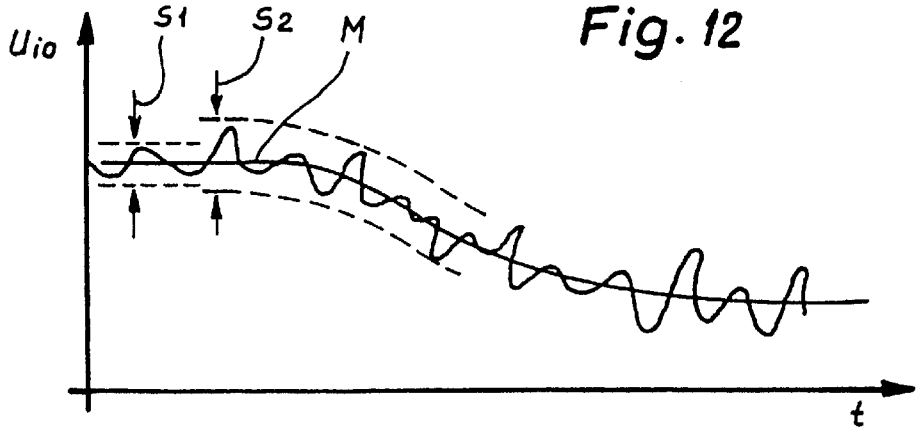
FIG. 12 shows an example of the curve of the ionization voltage with variations (flickering) caused by the combustion.

With the flame burning, an ionization signal ionization voltage Uio, as is shown in, e.g., FIG. 12, is present at the output 211 of the filter 210. The ionization signal varies corresponding to the spontaneously occurring flickering of the flame variation in the flame intensity around a mean value M. Weaker variations, which are indicated by the band width S1 in FIG. 12, and stronger variations, which are represented by the band width S2 in FIG. 12, occur one after another in the course of the variations. Aside from this, the band width changes as a function of the lambda value, which is described in DE 195 02 901 C1.

FIG. 12 shows as an example a mean value M curve declining over time. This mean value is obtained in the case of a change in the air ratio lambda value of the particular combustion process and is in proportion to the particular lambda value.

A first functional block 212 is connected to the output 211. This functional block rectifies or filters out the variations caused by the flickering such that the above-mentioned mean value M is available at the output 213 of the first functional block 212.

Figure 13:
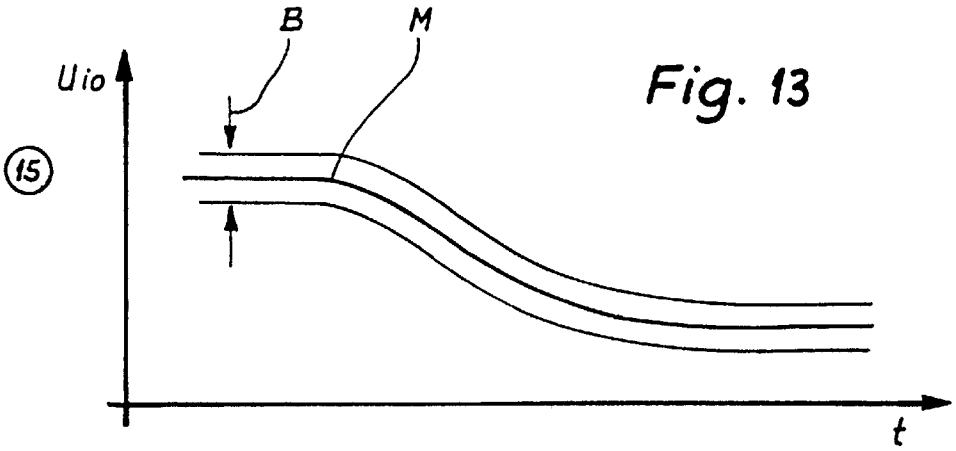
FIG. 13 shows the curve of the ionization voltage without the variations.

The output 213 of the first functional block 212 is followed by a second functional block 214, which generates an amplitude tolerance range, which is located around the mean value M and whose width is indicated by B in FIG. 13. The width B of the tolerance range is selected to be such that it is narrower than the narrowest band width S1 of the variations.

The output 215 of the functional block 214 is connected to a comparator functional block 216, to which the output 211 is also connected. The output of the comparator functional block 216 is connected to a resetting input of a timer 217, which acts on a control device 218 for the gas valve 4. Such a control device 218 is commonly used as an "automatic firing unit."

In the context that is of interest here, the control device 218 only has to convert the output signal of the timer 217 into a switch-off signal for the gas valve 4.

The comparator functional block 216 performs a continuous comparison to determine whether an amplitude variation, which is outside or within the amplitude tolerance range B, occurs in the ionization signal Uio. If such an amplitude variation occurs, the comparator functional block 216 sends a resetting signal to the timer 217.

The timer 217 is reset to zero by each resetting signal of the comparator functional block 216, after which it starts counting anew. If the period of time preset on the timer 217, e.g., 5 sec, has expired, and no resetting signal has occurred during this period of time, the timer 217 sends a gas switch-off signal to the control device 218, which will then close the gas valve 4. The period of time is set such that a variation in the amplitude of the ionization signal occurs during it with certainty in the case of the regular, undisturbed operation of the burner. To prevent the sensitivity from becoming too high, provisions may also be made for the gas valve to be switched off only when a number, e.g., two or three, gas switch-off signals follow each other.

The device described operates essentially as follows:

a) During regular, undisturbed operation, i.e., when the flame is present, the comparator functional block 216 recognizes that the variations in amplitude occur, and that they are outside or within the preset tolerance range B. This happens regardless of the particular level of the mean value M of the ionization signal, which is important, because the ionization signal, i.e., its mean value M, may change during the normal operation of the burner, and such a change shall not lead to a safety switch-off. The comparator functional block 216 always sends a resetting signal to the timer 217 at the time of each variation in amplitude before the period of time set on the timer has expired. Consequently, no gas switch-off signal appears.

b) If the flame goes out, there is no ionization signal, so that the comparator functional block 216 does not generate any resetting signal. The timer 217 will correspondingly run and send a gas switch-off signal to the control device 218 when the end of the preset time is reached. The gas valve 4 will be closed.

c) If there is a defect in the device, whether the flame is burning or not, e.g., in the ionization electrode 5, its connection line or the other devices 27 through 216, and this defect leads to a signal that is only similar to the ionization signal Uio present at the output 211 or to a signal similar to the signal present at the output 215, the comparator functional block 216 recognizes that the characteristic amplitude variations are missing, and it does not send any resetting signal to the timer 217, so that the gas switch-off signal will appear. Consequently, a gas switch-off signal appears in the case of different disturbances or defects whenever the variations in amplitude are not present or are not recognized, or when they are present but are not outside the tolerance range B in either direction.

Figure 11:
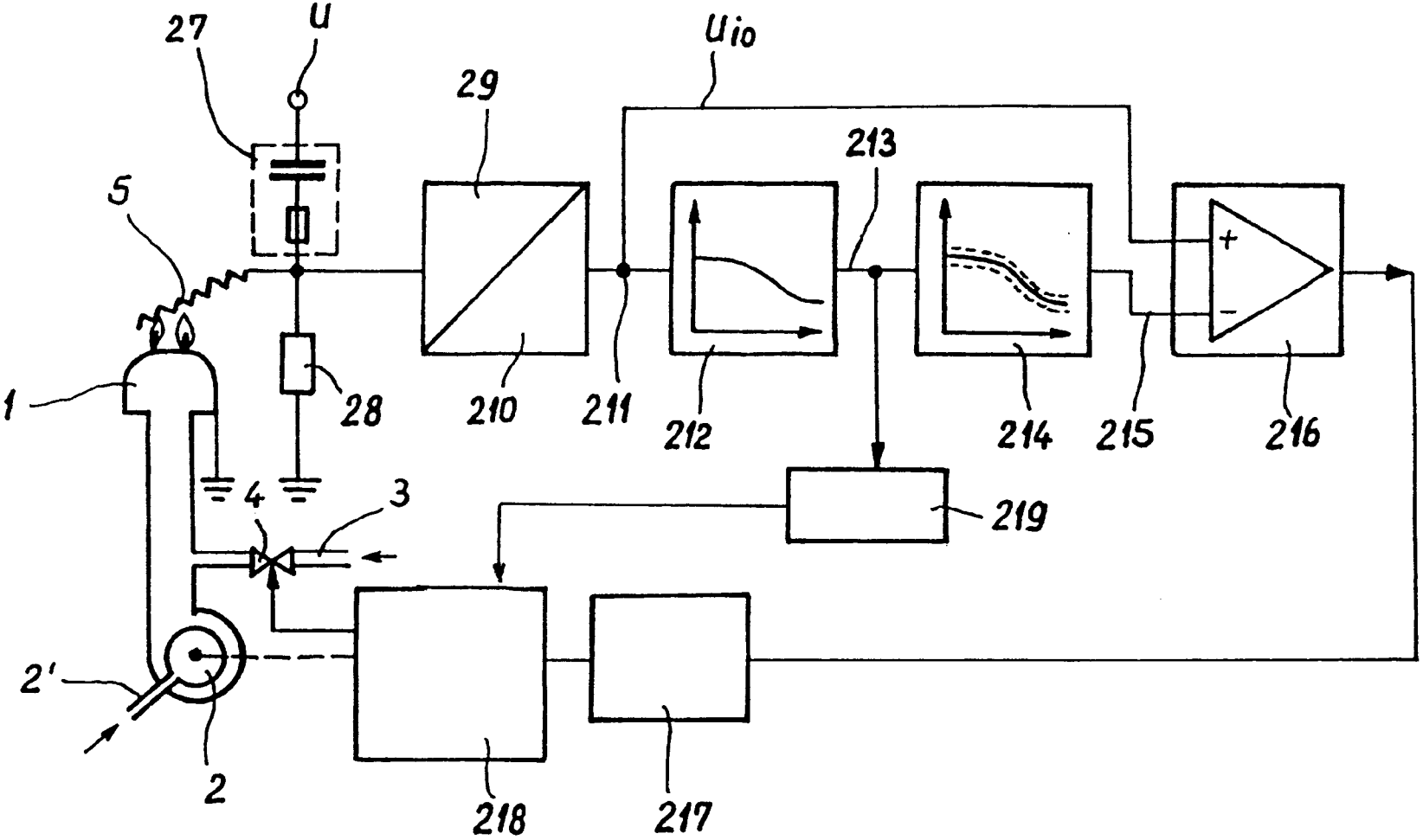
FIG. 11 shows a block diagram of a first exemplary embodiment.

According to FIG. 11, a control circuit 219 or 7, as is described in, e.g., DE 44 33 425 A1, is connected to the output 213. The gas valve 4 and/or the blower 2 is controlled with this control circuit such that optimal combustion is achieved at a desired lambda set point with different gas qualities and under different environmental conditions.

Figure 14:
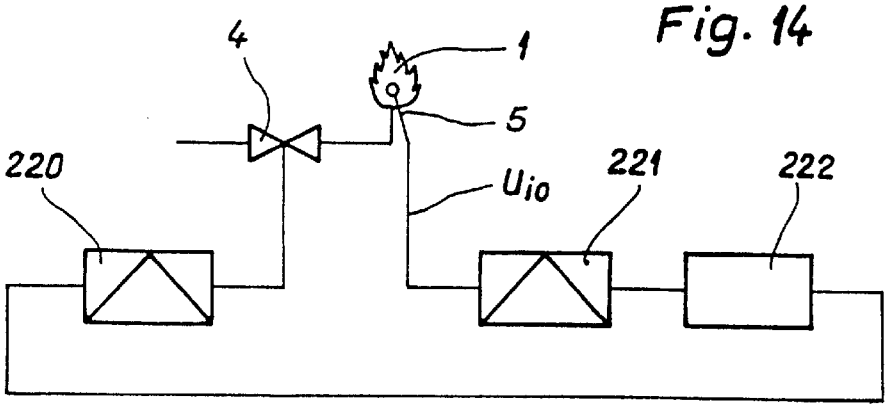
FIG. 14 shows a block diagram of another exemplary embodiment.

The control circuit 219 and the components 29 through 217 described can be embodied in a microcontroller or microprocessor. The effort for the flame safety monitoring is thus small. FIG. 14 schematically shows another exemplary embodiment. Parts corresponding to FIG. 11 are designated with the same reference numbers. A modulator 220 is connected to the gas valve 4. This modulator modulates the gas supply to the gas burner 1 such that variations occur in the intensity of the flame. Such induced variations in the flame intensity can also be achieved by specifically modulating the air supply, e.g., by means of the blower 2 see FIG. 11.

These variations, which are specifically modulated to the flame pattern, are depicted in the ionization signal Uio in the case of undisturbed burner operation. A demodulator 221 tuned to the modulator 220 detects these characteristic variations. A flame monitoring circuit 222 connected to the demodulator 221 monitors whether the variations generated by the modulator 220 appear in the demodulator 221, and it sends a gas switch-off signal to the gas valve 4 via the modulator 220 or directly when the variations are not recognized by the demodulator 221.

The mode of operation is likewise essentially as follows:

a) No gas switch-off signal appears during undisturbed operation of the burner, with flame present, because the demodulator 221 detects the variations caused by the modulator 220.

b) If the flame goes out, the variations caused by the modulator 220 cannot reach the demodulator 221. The consequence of this is that the flame monitoring circuit 222 generates a gas switch-off signal.

c) In the case of any defect in the range of action of the modulator-gas valve-flame-ionization electrode-demodulator-flame monitoring circuit of the system, the modulation signal does not reach the demodulator 221 correctly. A gas switch-off signal is then generated.

The modulation may be performed continuously or periodically, e.g., every 5 sec to 10 sec, during a time that is short compared with this, e.g., 1 sec to 3 sec. A periodic modulation guarantees that the modulation will affect the lambda value of the combustion process only slightly when considering the burning time.

The control circuit 219 or 7 is not shown in FIG. 14. It may be present in this exemplary embodiment as well. If the control circuit uses a microprocessor or a microcontroller, the function of the flame safety monitoring may be simply integrated in this exemplary embodiment as well.

While specific embodiments of the invention have been shown and described in detail to illustrate the application of the principles of the invention, it will be understood that the invention may be embodied otherwise without departing from such principles.

What is claimed is:

1. A process for operating a gas burner, the process comprising the steps of:

providing an ionization electrode in an area of a flame of the gas burner, said ionization electrode generating an ionization signal Ui representing an ionization of the flame;

determining a lambda set point which is greater than one for operation of the gas burner;

determining an ionization set point of said ionization signal corresponding to said lambda set point;

adjusting a lambda of the gas burner to cause said ionization signal to be equal to said ionization set point;

determining a control range for said ionization signal, said control range having an upper limit value Uio which is smaller than a maximum Uim of said ionization signal, and having a lower limit value Uiu which is above an end value Uie of said ionization signal, said end value Uie of said ionization signal corresponding to a lambda value "le" which is less than one and at which combustion of the flame is not low emission;

switching off the gas burner when said ionization signal is outside said control range for longer than a preset period of time;

switching off the gas burner when said ionization signal drops below said lower limit value Uiu of said ionization signal Ui and when said ionization signal drops below said ionization set point Uis at a lambda value <1 as a consequence of positive feedback of said adjusting causing one of gas volume flow to be increased and air volume flow to be throttled to cause said lambda to reach an end value le and said ionization signal to reach end value Uie.

2. A process in accordance with claim 1, further comprising:

restarting the gas burner after said switching off;

performing a disturbance switch-off if said switching off is performed several times one after another.

3. A process in accordance with claim 1, further comprising:

switching off the gas burner when said ionization signal is outside said control range for longer than a continuous preset period of time.

4. A process in accordance with claim 1, wherein:

said adjusting includes varying a gas control signal J controlling a gas solenoid valve;

said end value of said ionization signal is one of a maximum and minimum of said gas control signal J.

5. A process in accordance with claim 4, further comprising:

providing a safety gas valve;

closing said safety gas valve when said minimum of said control signal J of said gas solenoid valve is detected electronically.

6. A process in accordance with claim 1, further comprising:

starting the gas burner by increasing a gas volume flow in a ramp-like pattern at a constant blower speed until the burner is ignited;

maintaining said gas flow constant immediately after the burner is ignited and until an end of a preset safety time T.

7. A process in accordance with claim 4, further comprising:

lowering said ionization set point to a low-caloric set point Uisn when an upper threshold value J1 of said control signal J is reached;

raising said low-caloric set point Uisn to said ionization set point Uis when a lower threshold value J2 of the control signal J has been reached.

8. A process in accordance with claim 1, further comprising:

calibrating said ionization signal Ui at regular intervals.

9. A process in accordance with claim 1, further comprising:

calibrating said ionization signal Ui at regular intervals, said calibrating including increasing said gas control signal J to a value for preheating of said ionization electrode, and further increasing said control signal J until said ionization signal creates a new maximum, and evaluating values obtained for said calibrating.

10. A process in accordance with claim 4, further comprising:

providing a prior-art automatic control unit with a safety valve and a gas pressure switch for controlling the gas burner, said prior-art automatic control unit receiving switching off signals during said switching off.

11. A process in accordance with claim 4, further comprising:

providing a prior-art automatic control unit with a safety valve and a gas pressure switch for controlling the gas burner, said automatic control unit controlling a blower speed corresponding to an output set point;

generating a derivative component dJ' for said control signal J from a particular change in said blower speed, wherein said derivative component dJ' changes said control signal J in a direction of a larger gas volume flow in a case of increasing blower speed and in a direction of a lower gas volume flow in a case of decreasing blower speed.

12. A process in accordance with claim 1, further comprising:

defining a tolerance range around the output control signal characteristic, and switching off the burner if the current control signal leaves said tolerance range.

13. A process in accordance with claim 1, further comprising:

detecting variations in said ionization signal which arise from variations in flame intensity;

switching off the gas burner if said variations of said ionization signal are not present.

14. A process in accordance with claim 1, further comprising:

modulating one of a combustion gas and a combustion air supply;

detecting variations in said ionization signal which arise from said modulating;

switching off the gas burner if said variations of said ionization signal are not present.

15. A device for operating a gas burner, the device comprising:

an ionization electrode in an area of a flame of the gas burner, said ionization electrode generating an ionization signal Ui representing an ionization of the flame;

control circuit means for receiving said ionization signal, said control circuit means having a predetermined lambda set point which is greater than 1 for operation of the gas burner and an ionization set point of said ionization signal corresponding to said lambda set point, said control circuit means adjusting a lambda of the gas burner to cause said ionization signal to be equal to said ionization set point, said control means having a predetermined control range for said ionization signal, said control range having an upper limit value Uio which is smaller than a maximum Uim of said ionization signal, and having a lower limit value Uiu which is above an end value Uie of said ionization signal, said end value Uie of said ionization signal corresponding to a lambda value "le" which is less than one and at which combustion of the flame is not low emission, said control circuit means switching off the gas burner when said ionization signal is outside said control range for longer than a preset period of time, said control means switching off the gas burner when said ionization signal equals said end value Uie.

16. A device in accordance with claim 15, further comprising:

detecting means for detecting variations in said ionization signal which arise from variations in flame intensity;

first functional block means for rectifying said variations of said ionization signal Ui into an output signal;

second functional block means downstream of said first functional block means and for generating an amplitude tolerance range B around said output signal of said first functional block means, wherein said amplitude tolerance range B is smaller than amplitude variations always recurring in the ionization signal Uio;

comparator means receiving said amplitude tolerance range B and the ionization signal Uio containing said variations, said comparator means sending a resetting signal if one of said variations in an amplitude of said ionization signal Ui goes outside said amplitude tolerance range B;

timer means generating a gas switch-off signal after another preset period of time, said timer means being reset by said resetting signal of said comparator means.

17. A device in accordance with claim 15, further comprising:

modulation means for modulating one of a combustion gas and a combustion air supply;

detecting means for detecting variations in said ionization signal due to said modulation means, said control circuit means switching off the gas burner if said variations of said ionization signal are not present.

18. A process for operating a gas burner, the process comprising the steps of:

providing an ionization electrode in an area of a flame of the gas burner, said ionization electrode generating an ionization signal Ui representing an ionization of the flame;

determining a lambda set point which is greater than 1 for operation of the gas burner;

determining an ionization set point of said ionization signal corresponding to said lambda set point;

adjusting a lambda of the gas burner to cause said ionization signal to be equal to said ionization set point;

determining a control range for said ionization signal, said control range having an upper limit value Uio which is smaller than a maximum Uim of said ionization signal, and having a lower limit value Uiu which is above an end value Uie of said ionization signal, said end value Uie of said ionization signal corresponding to a lambda value "le" which is less than one and at which combustion of the flame is not low emission;

switching off the gas burner when said ionization signal is outside said control range for longer than a preset period of time;

switching off the gas burner when said ionization signal equals said end value Uie.

19. A process in accordance with claim 18, wherein:

said maximum Uim of said ionization signal is when said lambda of the flame is equal to one;

said adjusting of said lambda using said ionization signal is by negative feedback when said lambda is greater than one, and said adjusting of said lambda using said ionization signal causes positive feedback when said lambda is less than one and said ionization signal is less than said ionization set point.

* * * * *